US009086036B2

(12) United States Patent
Inoguchi et al.

(10) Patent No.: US 9,086,036 B2
(45) Date of Patent: Jul. 21, 2015

(54) EVAPORATED FUEL PURGE DEVICE

(75) Inventors: Tetsunori Inoguchi, Hamamatsu (JP); Shinji Sugihara, Mizuho (JP)

(73) Assignees: HAMANAKODENSO CO., LTD., Shizuoka-pref. (JP); DENSO CORPORATION, Kariya (JP)

( * ) Notice: Subject to any disclaimer, the term of this patent is extended or adjusted under 35 U.S.C. 154(b) by 410 days.

(21) Appl. No.: 13/532,928

(22) Filed: Jun. 26, 2012

(65) Prior Publication Data

US 2013/0008413 A1 Jan. 10, 2013

(30) Foreign Application Priority Data

Jul. 5, 2011 (JP) ..... 2011-149485

(51) Int. Cl.

| | |
|---|---|
| ***F02M 33/04*** | (2006.01) |
| ***F02M 25/08*** | (2006.01) |
| *F02B 29/04* | (2006.01) |
| *F02B 37/00* | (2006.01) |

(52) U.S. Cl.

CPC ..... *F02M 25/0836* (2013.01); *F02B 29/0406* (2013.01); *F02B 37/00* (2013.01)

(58) Field of Classification Search

CPC ..... F02M 25/0836; F02M 33/04; F02M 25/0818; F02M 35/10144; F02M 35/10157; F02M 25/089; F02M 25/08; F02M 25/0872; F02M 37/0064; F02M 2025/0881; F02M 31/18; F02M 35/10255; F02M 69/044; F02D 41/0032; F02D 41/004; F02D 41/0045; F01N 3/0871; B01D 2259/4516; B01D 2259/4566; Y02T 10/144; Y02T 10/126

USPC ..... 123/520, 533, 516, 519, 521, 531, 517, 123/518, 559.1, 184.47; 701/102, 104, 103; 73/114.39; 60/283, 274; 137/15.18, 137/565.22, 587, 888, 907; 96/116

See application file for complete search history.

(56) References Cited

U.S. PATENT DOCUMENTS

| | | | | |
|---|---|---|---|---|
| 5,005,550 | A * | 4/1991 | Bugin et al. | 123/520 |
| 5,188,141 | A * | 2/1993 | Cook et al. | 137/112 |
| 5,190,015 | A * | 3/1993 | Nakata et al. | 123/520 |
| 6,446,618 | B1 * | 9/2002 | Hill | 123/698 |
| 6,695,895 | B2 * | 2/2004 | Hyodo et al. | 96/111 |

(Continued)

FOREIGN PATENT DOCUMENTS

| | | |
|---|---|---|
| JP | 2007-205231 A | 8/2007 |
| JP | 2007-332855 A | 12/2007 |
| JP | A-2008-38808 | 2/2008 |

OTHER PUBLICATIONS

Office Action mailed Mar. 17, 2015 issued in corresponding JP patent application No. 2011-149485 (and English translation).

*Primary Examiner* — Lindsay Low
*Assistant Examiner* — John Bailey
(74) *Attorney, Agent, or Firm* — Posz Law Group, PLC

(57) ABSTRACT

An evaporated fuel purge device integrally includes a main passage, a fuel inlet passage, a fuel outlet passage, an ejector, an air inlet passage, and an air outlet passage. Evaporated fuel flows into the main passage through the fuel inlet passage, and flow out of the main passage through the fuel outlet passage. Intake air flows into the ejector from a downstream of a turbocharger through the air inlet passage, and flows out of the ejector to an upstream of the turbocharger through the air outlet passage. At least three of the fuel inlet passage, the fuel outlet passage, the air inlet passage, and the air outlet passage are arranged to extend parallel with each other.

20 Claims, 2 Drawing Sheets

(56) References Cited

U.S. PATENT DOCUMENTS

| | | | | |
|---|---|---|---|---|
| 6,880,534 | B2 * | 4/2005 | Yoshiki et al. | 123/520 |
| 6,910,467 | B2 * | 6/2005 | Murakami et al. | 123/520 |
| 7,373,930 | B1 * | 5/2008 | Hadre | 123/520 |
| 7,383,856 | B2 * | 6/2008 | Martiš et al. | 137/587 |
| 7,634,348 | B2 * | 12/2009 | Hirooka | 701/103 |
| 7,762,068 | B2 * | 7/2010 | Tabata et al. | 60/608 |
| 7,905,218 | B2 * | 3/2011 | Fornara et al. | 123/520 |
| 7,913,672 | B2 * | 3/2011 | Elwart et al. | 123/519 |
| 8,112,985 | B2 * | 2/2012 | Uhrich et al. | 60/284 |
| 8,261,531 | B2 * | 9/2012 | Gandhi et al. | 60/283 |
| 8,333,063 | B2 * | 12/2012 | Elwart et al. | 60/287 |
| 8,375,701 | B2 * | 2/2013 | Lupescu et al. | 60/279 |
| 8,459,238 | B2 * | 6/2013 | Pursifull et al. | 123/516 |
| 8,459,240 | B2 * | 6/2013 | Lee et al. | 123/519 |
| 8,555,862 | B2 * | 10/2013 | Gottschalk et al. | 123/519 |
| 8,843,265 | B2 * | 9/2014 | Sager et al. | 701/33.6 |
| 2004/0237946 | A1 * | 12/2004 | Murakami et al. | 123/520 |
| 2005/0011498 | A1 * | 1/2005 | Yoshiki et al. | 123/520 |
| 2006/0272400 | A1 * | 12/2006 | Wakahara | 73/118.1 |
| 2007/0113541 | A1 * | 5/2007 | Jankovic | 60/285 |
| 2007/0119411 | A1 * | 5/2007 | Kerns | 123/295 |
| 2010/0012099 | A1 * | 1/2010 | Kerns et al. | 123/520 |
| 2010/0218749 | A1 * | 9/2010 | Fornara et al. | 123/520 |
| 2010/0223984 | A1 * | 9/2010 | Pursifull et al. | 73/114.39 |
| 2010/0224171 | A1 * | 9/2010 | Peters et al. | 123/520 |
| 2010/0263636 | A1 * | 10/2010 | Kerns et al. | 123/521 |
| 2011/0030659 | A1 * | 2/2011 | Ulrey et al. | 123/521 |
| 2011/0132331 | A1 * | 6/2011 | Pursifull | 123/478 |
| 2011/0247594 | A1 * | 10/2011 | Pursifull | 123/520 |
| 2012/0174897 | A1 * | 7/2012 | Ulrey et al. | 123/521 |
| 2012/0318243 | A1 * | 12/2012 | Williams | 123/520 |
| 2013/0008413 | A1 * | 1/2013 | Inoguchi et al. | 123/518 |
| 2013/0019844 | A1 * | 1/2013 | Kulkarni et al. | 123/520 |
| 2013/0104857 | A1 * | 5/2013 | Schulz | 123/520 |
| 2013/0152904 | A1 * | 6/2013 | Balsdon et al. | 123/518 |
| 2013/0199504 | A1 * | 8/2013 | Takeishi et al. | 123/520 |
| 2013/0220282 | A1 * | 8/2013 | Hadre et al. | 123/520 |
| 2013/0233287 | A1 * | 9/2013 | Leone | 123/520 |
| 2014/0096749 | A1 * | 4/2014 | Pearce et al. | 123/520 |
| 2014/0096750 | A1 * | 4/2014 | Pearce | 123/520 |
| 2014/0123961 | A1 * | 5/2014 | Kragh et al. | 123/520 |
| 2014/0196694 | A1 * | 7/2014 | Euliss et al. | 123/520 |
| 2014/0209069 | A1 * | 7/2014 | Peters et al. | 123/520 |
| 2014/0224225 | A1 * | 8/2014 | Kragh | 123/520 |
| 2014/0245997 | A1 * | 9/2014 | Zhelyaskov et al. | 123/519 |

* cited by examiner

EVAPORATED FUEL PURGE DEVICE

CROSS REFERENCE TO RELATED APPLICATION

This application is based on Japanese Patent Application No. 2011-149485 filed on Jul. 5, 2011, the disclosure of which is incorporated herein by reference in its entirety.

TECHNICAL FIELD

The present disclosure relates to an evaporated fuel purge device.

BACKGROUND

JP-A-2008-38808 describes an evaporated fuel purge device that is mounted to an engine having a turbocharger. When the turbocharger is not operating, inside of an intake manifold has a negative pressure because air is drawn by a piston. Fuel evaporated in a fuel tank is adsorbed by a canister, and the fuel in the canister is drawn into the intake manifold when a main purge control valve is opened.

When the turbocharger is operating, inside of the intake manifold has a positive pressure. Compressed air is accumulated in an accumulation tank at a downstream of the turbocharger, and is sent to an ejector from the accumulation tank. The evaporated fuel is drawn by the ejector using the compressed air, and is supplied to the intake manifold.

Furthermore, a sub purge control valve is opened by the supercharge pressure when inside of the intake manifold has the positive pressure and when the compressed air is not sufficiently stored in the accumulation tank. At this time, the fuel evaporated in the fuel tank is drawn to the upstream of the turbocharger.

Thus, the evaporated fuel purge device can supply the evaporated fuel into the intake manifold or the upstream of the turbocharger, when inside of the intake manifold comes to have the positive pressure in accordance with the operation of the turbocharger.

However, the main purge control valve and the ejector are intricately connected by various piping. The number of components used for producing the evaporated fuel purge device is increased, so it becomes difficult to mount the evaporated fuel purge device to a vehicle.

SUMMARY

According to an example of the present disclosure, art evaporated fuel purge device that purges fuel evaporated from a fuel tank to an engine having a turbocharger includes a main passage, a fuel inlet passage, a fuel outlet passage, a valve, a branch passage, an ejector, an air inlet passage, and an air outlet passage, all of which are integrated with each other. The evaporated fuel passes through the main passage. The evaporated fuel flows into the main passage through the fuel inlet passage, and flow out of the main passage through the fuel outlet passage. The valve is disposed in the main passage to open or close the main passage. The branch passage is branched from the main passage at a position downstream of the valve in a flowing direction of the evaporated fuel. The ejector has a drawing portion that is connected with the branch passage. Intake air flows into the ejector from a downstream of the turbocharger through the air inlet passage, and flows out of the ejector to an upstream of the turbocharger through the air outlet passage. The ejector is arranged between the air inlet passage and the air outlet passage in a flowing direction of the intake air. The intake air passes through the drawing portion, and the drawing portion draws the evaporated fuel from the branch passage using the intake air passing through the drawing portion. At least three of the fuel inlet passage, the fuel outlet passage, the air inlet passage, and the air outlet passage are arranged to extend parallel with each other in an extending direction.

The fuel inlet passage is connected to the fuel tank, and the fuel outlet passage is connected to an intake manifold of the engine. The air inlet passage is connected to the downstream of the turbocharger, and the air outlet passage is connected to the upstream of the turbocharger.

When the valve is opened while the turbocharger is not operated, a negative pressure generated in the intake manifold causes the evaporated fuel to flow through the fuel inlet passage, the main passage, the valve, the main passage and the fuel outlet passage so as to be drawn into the intake manifold.

When the turbocharger is operating, the inside of the intake manifold has a positive pressure, so it becomes difficult to draw the evaporated fuel. However, because the intake air passes through the inside of the ejector, when the valve is opened, the drawing portion of the ejector draws the evaporated fuel through the fuel inlet passage, the main passage, the valve, and the branch passage, and the drawn evaporated fuel is supplied from the air outlet passage to the upstream of the turbocharger together with the intake air flowing through the ejector.

Thus, the evaporated fuel can be supplied to the intake manifold or the upstream of the turbocharger when the engine is equipped with the turbocharger.

The evaporated fuel purge device is integrally constructed of the fuel inlet passage, the fuel outlet passage, the main passage, the valve, the branch passage, the air inlet passage, the air outlet passage and the ejector, so the number of components can be reduced to make the device compact. Accordingly, the device can be easily mounted to the vehicle.

Further, at least three of the fuel inlet passage, the fuel outlet passage, the air inlet passage, and the air outlet passage are arranged to extend parallel with each other, so the size of the device can be reduced to be made compact in a direction intersecting with the parallel-extending direction. The connection directions can be unified and the connection operability can be improved when the device is interposed between the engine and the fuel tank.

For example, all of the fuel inlet passage, the fuel outlet passage, the air inlet passage, and the air outlet passage may be arranged to extend parallel with each other in the extending direction.

Therefore, the size of the device can be reduced to be made compact in the direction intersecting with the parallel-extending direction. The connection directions can be unified and the connection operability can be improved when the device is interposed between the engine and the fuel tank.

For example, the evaporated fuel purge device may further include a first check valve disposed in the main passage at a position between the fuel outlet passage and a branch point from which the branch passage is branched from the main passage. The first check valve restricts the evaporated fuel from flowing from the fuel outlet passage to the fuel inlet passage.

When the turbocharger is operated, the inside of the intake manifold has the positive pressure, and the evaporated fuel tries to flow backward from the intake manifold to the fuel outlet passage, further, toward the fuel inlet passage through the valve. However, the first check valve restricts the evaporated fuel from flowing backward.

For example, the evaporated fuel purge device may further include a second check valve disposed in the branch passage, and the second check valve restricts the evaporated fuel from flowing from the air inlet passage to the fuel inlet passage.

If a clogging is generated between the air outlet passage and the upstream of the turbocharger, the evaporated fuel tries to flow backward from the downstream of the turbocharger to the fuel inlet passage through the air inlet passage, the drawing portion, and the valve, due to the intake air pressurized by the turbocharger. However, the second check valve restricts the evaporated fuel from flowing backward.

For example, an overall dimension of the air inlet passage, the air outlet passage, and the ejector in the extending direction is set smaller than an overall dimension of the fuel inlet passage, the fuel outlet passage, and the main passage in the extending direction.

The evaporated fuel purge device of the present disclosure is constructed by mounting the small-size ejector to a conventional purge valve having only the valve. Therefore, the size of the device can be made smaller as a whole.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
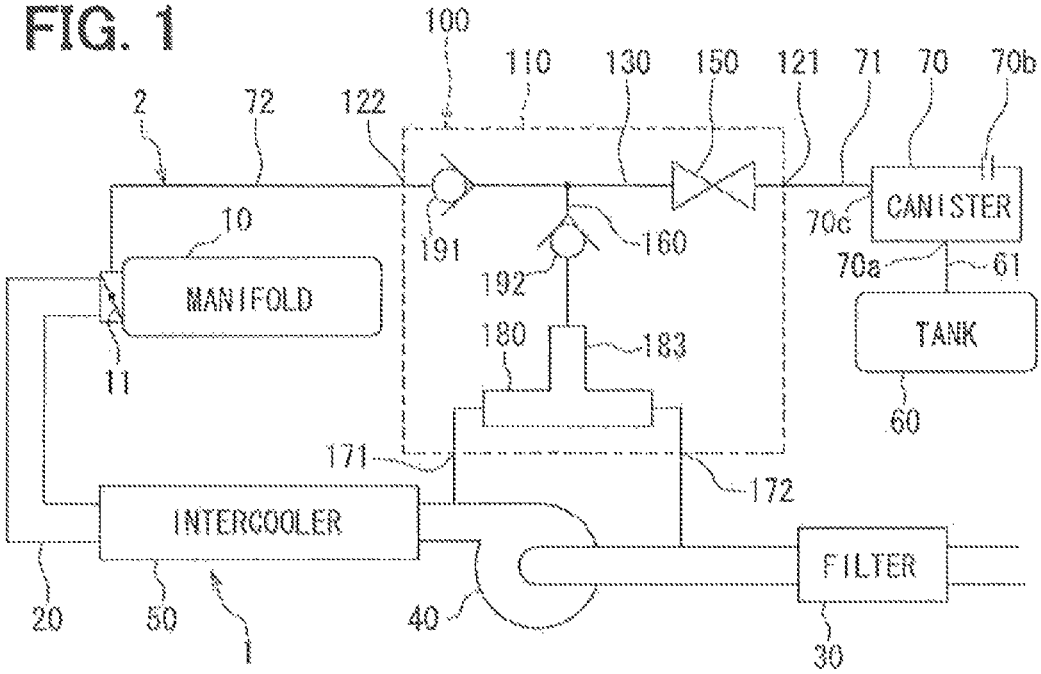
FIG. 1 is a schematic block diagram illustrating an evaporated fuel purge device according to an embodiment.
Figure 2:
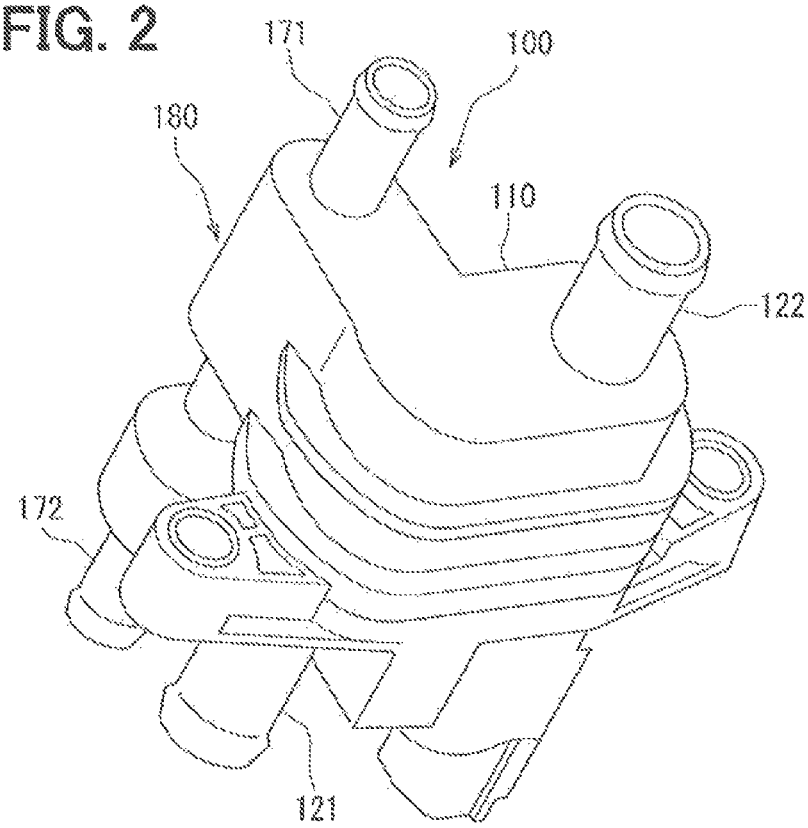
FIG. 2 is a perspective view illustrating the evaporated fuel purge device.
Figure 3:
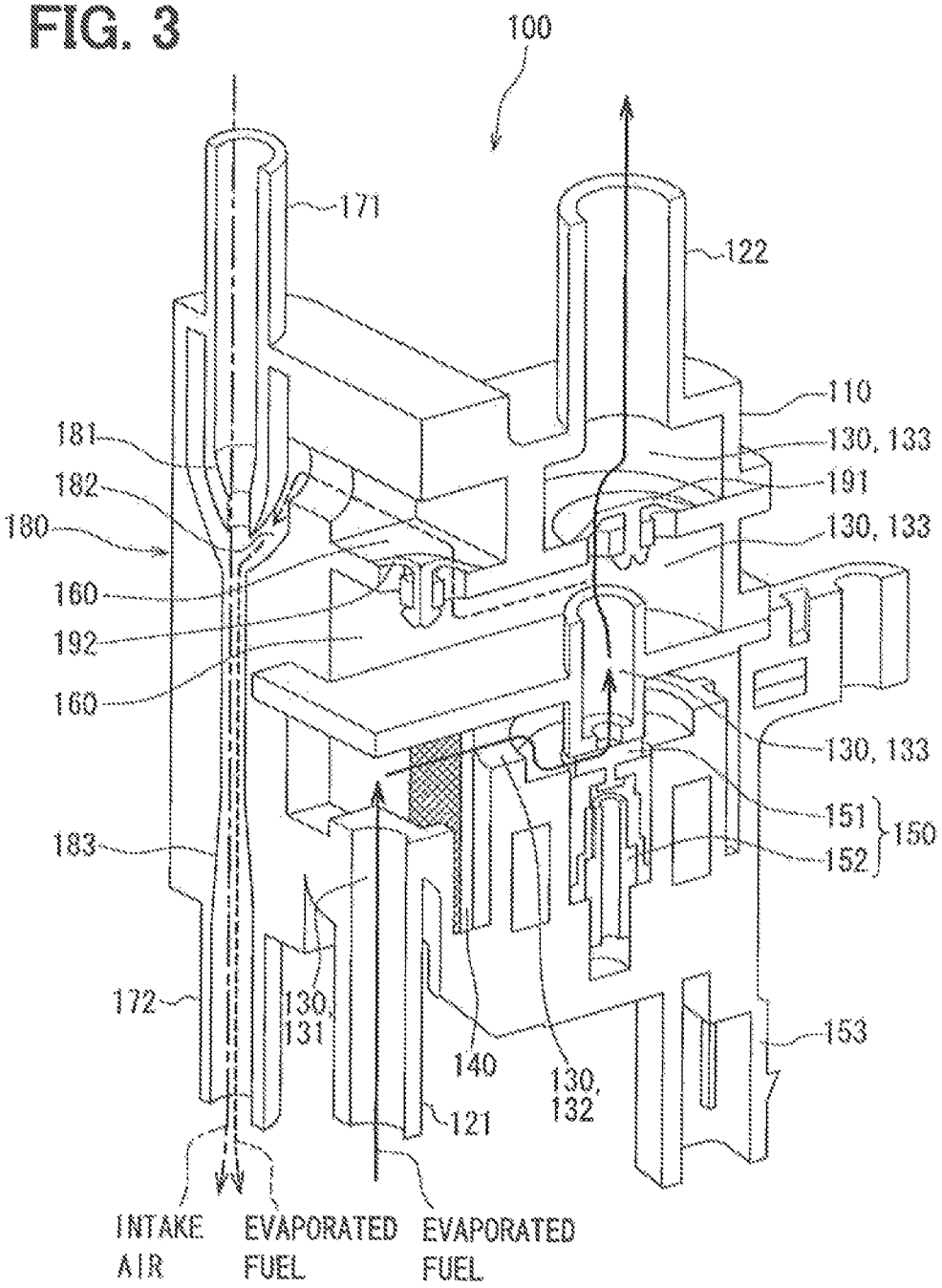
FIG. 3 is a perspective cross-sectional view illustrating the evaporated fuel purge device.

An evaporated fuel purge device 100 according to an embodiment will be described with reference to FIGS. 1-3.

Fuel is evaporated from a fuel tank 60, and the evaporated fuel purge device 100 introduces and purges the evaporated fuel into an air intake system 1 of an engine, so that the evaporated fuel is restricted from being emitted into atmospheric air, for example, when a vehicle is refueled. The fuel introduced into the air intake system 1 is mixed with fuel supplied from an injector (not shown), and the mixed fuel is combusted in a cylinder of the engine. The evaporated fuel purge device 100 is connected to the air intake system 1 and an evaporated fuel purge system 2.

The air intake system 1 includes an intake manifold 10, and an intake pipe 20 connected to the intake manifold 10. The air intake system 1 further includes a filter 30, a turbocharger 40, an intercooler 50, and a throttle valve 11 which are arranged in the intake pipe 20.

The filter 30 is disposed at the most upstream part of the intake pipe 20 in a flowing direction of intake air, and collects dust contained in the intake air. The turbocharger 40 is a compressor that raising the filling efficiency of intake air, and is arranged at the downstream of the filter 30 in the flowing direction of intake air. A turbine of the turbocharger 40 is operated by energy of gas exhausted from the engine, and a compressor working with the turbine pressurizes the intake air passing through the filter 30.

The intercooler 50 is a heat exchanger for cooling, and is arranged at the downstream of the turbocharger 40 in the flowing direction of intake air. In the intercooler 50, heat is exchanged between the intake air pressurized by the turbocharger 40 and outside air, so as to cool the intake air using the outside air. The throttle valve 11 is a control valve controlling the amount of intake air, and is interlocked with an accelerator pedal (not shown) so as to adjust the opening of the air inlet port of the intake manifold 10, therefore the amount of intake air flowing into the intake manifold 10 can be controlled. Intake air flows into the intake manifold 10 by passing through the filter 30, the turbocharger 40, the intercooler 50 and the throttle valve 11, and is mixed with fuel injected from the injector to have a predetermined air-fuel ratio, so as to be combusted in the cylinder of the engine.

The evaporated fuel purge device 100 has an air inlet pipe 171 and an air outlet pipe 172. A part, of the intake pipe 20 located downstream of the turbocharger 40, which is located between the turbocharger 40 and the intercooler 50, is connected to the air inlet pipe 171. Intake air flows into the evaporated fuel purge device 100 through the air inlet pipe 171. A part of the intake pipe 20 located upstream of the turbocharger 40, which is located between the filter 30 and the turbocharger 40, is connected to the air outlet pipe 172, intake air flows out of the evaporated fuel purge device 100 through the air outlet pipe 171

The evaporated fuel purge system 2 includes a canister 70 in addition to the fuel tank 60. The fuel tank 60 and the canister 70 are connected to the intake manifold 10 through a tank pipe 61, a canister pipe 71 and a manifold pipe 72. The evaporated fuel purge device 100 is interposed between the canister pipe 71 and the manifold pipe 72.

The fuel tank 60 is a container storing fuel such as gasoline. The fuel tank 60 is connected to an inlet **70*a* of the canister 70 through the tank pipe 61. The canister 70 is a container filled with adsorption material such as activated carbon. The fuel evaporated in the fuel tank 60 is drawn into the inlet 70*a* through the tank pipe 61, and is temporarily adsorbed by the adsorption material. The canister 70 has an aspiration hole 70*b* for drawing fresh outside air. The fuel adsorbed by the adsorption material is easily separated from the adsorption material due to the fresh outside air. An atmospheric pressure acts on the canister 70 because the aspiration hole 70*b* is defined in the canister 70**.

The canister 70 has an outlet **70*c* through which the fuel separated from the adsorption material flows out of the canister 70. A first end of the canister pipe 71 is connected to the outlet 70*c*, and the other end of the canister pipe 71 is connected to a fuel inlet pipe 121 of the evaporated fuel purge device 100. A first end of the manifold pipe 72 is connected to a fuel outlet pipe 122 of the evaporated fuel purge device 100, and the other end of the manifold pipe 72 is connected to a fuel inlet of the intake manifold 10**.

The evaporated fuel purge device 100 is equipped with the fuel inlet pipe 121, the fuel outlet pipe 122, the air inlet pipe 171, and the air outlet pipe 172. As shown in FIG. 2, the fuel inlet pipe 121, the fuel outlet pipe 122, the air inlet pipe 171, and the air outlet pipe 172 are projected from a main part 110 of the evaporated fuel purge device 100. Furthermore, as shown in FIG. 3, a main passage 130, a filter 140, a valve 150, a branch passage 160, an ejector 180, a first check valve 191, and a second check valve 192 are integrally arranged inside of the main part 110 of the evaporated fuel purge device 100.

The fuel inlet pipe 121 defines a fuel passage through which the evaporated fuel flowing out of the canister 70 flows into the main part 110 (i.e., the main passage 130, the branch passage 160, the ejector 180), and is disposed on a first side of the main part 110.

The fuel outlet pipe 122 defines a fuel passage through which the evaporated fuel passing through the main passage 130 flows out of the main part 110, and is disposed on a second side of the main part 110. The axis direction of the fuel outlet pipe 122 is approximately the same as the axis direction of the fuel inlet pipe 121. The axial center of the fuel outlet pipe 122 and the axial center of the fuel inlet pipe 121 are offset from each other. The fuel outlet pipe 122 and the fuel inlet pipe 121 are arranged to extend approximately parallel with each other in an extending direction.

The main passage 130 is defined inside of the main part 110, and connects the fuel inlet pipe 121 and the fuel outlet pipe 122 with each other. The evaporated fuel flows through the main passage 30 having a first passage 131, a second passage 132 and a third passage 133. The first passage 131 extends along a longitudinal direction of the fuel inlet pipe 121. The second passage 132 extends in a direction crossing the first passage 131. The third passage 133 extends from the second passage 132 toward the fuel outlet pipe 122 in the same direction as the first passage 131. The main passage 130 has a crank shape constructed by the first passage 131, the second passage 132 and the third passage 133.

The filter 140 collects dust contained in the evaporated fuel, and is arranged in a middle of the second passage 132. The filter 140 is made of a mesh component having minute net shape, for example.

The valve 150 opens or close the main passage 130, and is arranged in a middle of the main passage 130. The valve 150 is located downstream of the filter 140 and is disposed in an area at which the second passage 132 is shifted to the third passage 133. The valve 150 is a solenoid valve having a valve body 151, an electromagnet coil 152, and a spring (not shown). The valve 150 opens or closes the main passage 130 by balance between an electromagnetic force generated when electricity is supplied to the magnet coil 152 through a connector 153 by a control unit (not shown) and an elastic force of the spring.

The valve 150 is maintained to close the main passage 130 in normal time. When electricity is supplied to the magnet coil 152 from the control unit, the electromagnetic force overcomes the elastic force of the spring, so that the main passage 130 is opened. The control unit controls the flow rate of the evaporated fuel passing through the main passage 130 by adjusting a duty ratio energizing the magnet coil 152. The duty ratio represents a ratio of ON time over one cycle constructed by the ON time and OFF time. The energizing is stopped during the OFF time and is continued during the ON time.

The branch passage 160 is branched from a middle of the main passage 130 downstream of the valve 150. That is, the branch passage 160 is branched from a middle of the third passage 133. The branch passage 160 extends in a direction crossing the third passage 133, and a downstream of the branch passage 160 is connected to a drawing portion 182 of the ejector 180.

The air inlet pipe 171 defines a passage through which a part of the intake air pressurized by the turbocharger 40 flows into the inside of the main part 110 (i.e., the ejector 180), and is arranged on the same side of the main part 110 as the fuel outlet pipe 122.

The air outlet pipe 172 defines a passage through which intake air passing through the inside of the ejector 180 flows out of the main part 110, and is arranged on the same side of the main part 110 as the fuel inlet pipe 121. The axial center of the air outlet pipe 172 is coincident with the axial center of the air inlet pipe 171. The axis direction of the air inlet pipe 171 and the air outlet pipe 172 is approximately the same as the axis direction of the fuel inlet pipe 121 and the fuel outlet pipe 122. That is, the fuel outlet pipe 122, the fuel inlet pipe 121, the air inlet pipe 171 and the air outlet pipe 172 are arranged to extend approximately parallel with each other in the extending direction.

The ejector 180 is a fluid pump which draws the evaporated fuel using negative pressure generated when the pressurized intake air passes inside of the ejector 180, and has a nozzle part 181, the drawing portion 182, and a diffuser part 183. The ejector 180 is arranged between the air inlet pipe 171 and the air outlet pipe 172.

The nozzle part 181 is a passage defining a throttle throttling the intake air flowing into. A first end of the nozzle part 181 is connected with the air inlet pipe 171, and a second end (tip side) of the nozzle part 181 extends toward the air outlet pipe 172. The inside diameter of the nozzle part 181 is made to be gradually smaller toward the tip side. The nozzle part 181 raises the flow velocity of the intake air flowing from the air inlet pipe 171 by the throttle effect. Therefore, the high-speed intake air flowing out of the tip side of the nozzle part 181 produces a negative pressure.

The drawing portion 182 defines a passage extending in a direction crossing the nozzle part 181, and is connected to the tip side of the nozzle part 181. The drawing portion 182 is connected with the branch passage 160, and draws the evaporated fuel of the branch passage 160 due to the negative pressure of the nozzle part 181.

The diffuser part 183 defines a passage extending toward the air outlet pipe 172 at the downstream of the nozzle part 181 and the drawing portion 182, and the inside diameter of the diffuser part 183 is gradually increased toward the air outlet pipe 172. A first end of the diffuser part 183 is connected to the nozzle part 181 and the drawing portion 182, and a second end of the diffuser part 183 is connected to the air outlet pipe 172 through the diameter-increased part. The diffuser part 183 reduces the flow velocity of the intake air and the evaporated fuel flowing inside and raises the pressure of the intake air and the evaporated fuel.

The axial center of the nozzle part 181 and the diffuser part 183 is in agreement with the axial center of the air inlet pipe 171 and the air outlet pipe 172. That is, the nozzle part 181, the diffuser part 183, the air inlet pipe 171, and the air outlet pipe 172 have the same axial center.

An overall dimension of a part constructed by combining the air inlet pipe 171, the air outlet pipe 172, and the ejector 180 in the flowing direction of the intake air (corresponding to the extending direction of the air pipe 171, 172) may be set to be smaller than an overall dimension of a part constructed by combining the fuel inlet pipe 121, the fuel outlet pipe 122, and the main passage 130 in the flowing direction of the evaporated fuel (corresponding to the extending direction of the fuel pipe 121, 122). Here, the extending direction of the air pipe 171, 172 and the extending direction of the fuel pipe 121, 122 are approximately the same.

The first check valve 191 is arranged in the main passage 130 at a position between a branch point from which the branch passage 160 is branched from the main passage 130 and the fuel outlet pipe 122. That is, the first check valve 191 is arranged in the third passage 133. The first check valve 191 allows the evaporated fuel to flow from the fuel inlet pipe 121 to the fuel outlet pipe 122, and prohibits the evaporated fuel from flowing from the fuel outlet pipe 122 to the fuel inlet pipe 121. The first check valve 191 has a kind of mushroom shape that opens the passage for the evaporated fuel flowing in the allowed direction and that closes the passage for the evaporated fuel flowing in the backward direction.

The second check valve 192 is arranged in the branch passage 160. The second check valve 192 allows the evaporated fuel to flow from the fuel inlet pipe 121 to the air outlet pipe 172, and prohibits the evaporated fuel from flowing from the air inlet pipe 171 to the fuel inlet pipe 121. Similarly to the first check valve 191, the second check valve 192 has a kind of mushroom shape that opens the passage for the evaporated fuel flowing in the allowed direction and that closes the passage for the evaporated fuel flowing in the backward direction.

Operation of the evaporated fuel purge device 100 will be described hereinafter. The evaporated fuel purge device 100 conducts a normal purge when the turbocharger 40 is not operated, and conducts a supercharging purge when the turbocharger 40 is operated.

(Normal Purge)

While the vehicle is traveling, in a case where the turbocharger 40 is not operating, when the valve 150 is opened by the control unit, due to a difference between the negative pressure in the intake manifold 10 generated by a piston and an atmospheric pressure acting on the canister 70, the evaporated fuel adsorbed in the canister 70 flows in order of the fuel inlet pipe 121, the main passage 130 (the first passage 131, the second passage 132), the valve 150, the main passage 130 (third passage 133), the first check valve 191, the main passage 130 (third passage 133), and the fuel outlet pipe 122, to be drawn into the intake manifold 10.

The evaporated fuel drawn into the intake manifold 10 is mixed with fuel supplied to the engine from the injector, and is combusted in a cylinder of the engine.

An air-fuel ratio which is a mixing ratio of fuel for combustion and intake air is controlled to have a predetermined value in the cylinder of the engine. The control unit controls the purge amount of the evaporated fuel by carrying out the duty control for the open/close time of the valve 150. Therefore, a predetermined air-fuel ratio can be maintained while the evaporated fuel is purged.

(Supercharging Purge)

While the vehicle is traveling, in a case where the turbocharger 40 is operating, the intake manifold 10 has a positive pressure, due to the pressurized intake air, so it becomes difficult to conduct the drawing of the evaporated fuel explained in the above normal purge. At the time of supercharging, a part of intake air supercharged by the turbocharger 40 flows through the ejector 180 from the air inlet pipe 171, and returns to the upstream of the turbocharger 40 through the air outlet pipe 172.

At this time, when the control unit opens the valve 150, due to the suction action of the drawing portion 182 of the ejector 180, evaporated fuel adsorbed in the canister 70 flows in order of the fuel inlet pipe 121, the main passage 130 (the first passage 131, the second passage 132), the valve 150, the main passage 130 (the third passage 133), and the branch passage 160, to be drawn into the ejector 180 through the drawing portion 182. Then, the evaporated fuel is supplied to the upstream of the turbocharger 40 through the air outlet pipe 172 together with the intake air inside of the ejector 180.

The evaporated fuel supplied to the upstream of the turbocharger 40 reaches the intake manifold 10 through the intake pipe 20, and is mixed with fuel for combustion supplied to the engine from the injector so as to be combusted in the cylinder of the engine.

In this case, the control unit controls the purge amount of the evaporated fuel by carrying out the duty control of the open/close time of the valve 150. Therefore, a predetermined air-fuel ratio can be maintained while the evaporated fuel is purged to the intake pipe 20.

Thus, the evaporated fuel purge device 100 can supply the evaporated fuel to the intake manifold 10 or the upstream of the turbocharger 40, when the engine is equipped with the turbocharger 40.

The evaporated fuel purge device 100 integrally has the fuel inlet pipe 121, the fuel outlet pipe 122, the main passage 130, the valve 150, the branch passage 160, the air inlet pipe 171, the air outlet pipe 172, and the ejector 180. Therefore, the number of components necessary for producing the evaporated fuel purge device 100 can be reduced. Further, because the evaporated fuel purge device 100 can be made compact, it becomes easy to mount the evaporated fuel purge device 100 to the vehicle.

Moreover, the fuel inlet pipe 121, the fuel outlet pipes 122, the air inlet pipe 171, and the air outlet pipe 172 are arranged to become parallel with each other. Therefore, a size of the evaporated fuel purge device 100 can be reduced in a direction crossing the parallel-extending direction, so as to be made compact. Further, when the evaporated fuel purge device 100 is fixed to the engine (air intake system 1) and the fuel tank 60 (evaporated fuel purge system 2), all the connection directions can be unified and the workability can be raised at the time of the connection.

The first check valve 191 is arranged in the main passage 130 at the position between the fuel outlet pipe 122 and the branch point of the branch passage 160. Therefore, the back flow of the evaporated fuel can be prevented by the first check valve 191. Specifically, even when the inside of the intake manifold 10 has a positive pressure while the turbocharger 40 is operating, the evaporated fuel is restricted from flowing backward from the intake manifold 10 to the fuel inlet pipe 121 (fuel tank 60) through the fuel outlet pipe 122 and the valve 150.

The second check valve 192 is arranged in the branch passage 160. In a case where a clogging is generated between the air outlet pipe 172 and the upstream of the turbocharger 40, the intake air pressurized by the turbocharger 40 may cause a back flow of the evaporated fuel. However, the second check valve 192 restricts the evaporated fuel from flowing backward from the downstream of the turbocharger 40 to the fuel inlet pipe 121 (fuel tank 60) through the air inlet pipe 171, the drawing portion 182, and the valve 150.

An overall dimension of a part constructed by combining the air inlet pipe 171, the air outlet pipe 172, and the ejector 180 in the extending direction may be set to be smaller than an overall dimension of a part constructed by combining the fuel inlet pipe 121, the fuel outlet pipe 122, and the main passage 130 in the extending direction. The evaporated fuel purge device 100 is constructed by integrally mounting the small-size ejector 180 to a conventional purge valve having only a valve. Thus, the size of the evaporated fuel purge device 100 can be made smaller as a whole.

It is not limited that the fuel inlet pipe 121, the fuel outlet pipe 122, the air inlet pipe 171, and the air outlet pipe 172 have the same axis direction. At least three of the fuel inlet pipe 121, the fuel outlet pipe 122, the air inlet pipe 171, and the air outlet pipe 172 may have the same axis direction.

The second check valve 192 may be eliminated if a frequency for the generation of the clogging between the air outlet pipe 172 and the upstream of the turbocharger 40 is sufficiently low.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

Such changes and modifications are to be understood as being within the scope of the present disclosure as defined by the appended claims.

What is claimed is:

1. An evaporated fuel purge device that purges fuel evaporated from a fuel tank to an engine having a turbocharger, the device comprising:

a main passage through which the evaporated fuel passes;

a fuel inlet passage through which the evaporated fuel flows into the main passage;

a fuel outlet passage through which the evaporated fuel flows out of the main passage;

a valve disposed in the main passage to open or close the main passage;

a branch passage branched from the main passage at a position downstream of the valve in a flowing direction of the evaporated fuel;

an ejector having a drawing portion that is connected with the branch passage;

an air inlet passage through which intake air flows into the ejector from a downstream of the turbocharger in a flowing direction of the intake air; and an air outlet passage through which the intake air flows out of the ejector to an upstream of the turbocharger in the flowing direction of the intake air, wherein the ejector is located between the air inlet passage and the air outlet passage in the flowing direction of the intake air, the intake air passing through the drawing portion, the drawing portion drawing the evaporated fuel from the branch passage using the intake air passing through the drawing portion, the fuel inlet passage, the fuel outlet passage, the main passage, the valve, the branch passage, the air inlet passage, the air outlet passage, and the ejector are formed integrally with each other, and at least three of the fuel inlet passage, the fuel outlet passage, the air inlet passage, and the air outlet passage are arranged to extend parallel with each other in an extending direction.

2. The evaporated fuel purge device according to claim 1, wherein all of the fuel inlet passage, the fuel outlet passage, the air inlet passage, and the air outlet passage extend parallel with each other in the extending direction.

3. The evaporated fuel purge device according to claim 1, further comprising:

a first check valve disposed in the main passage at a position between the fuel outlet passage and a branch point from which the branch passage is branched from the main passage, wherein the first check valve restricts the evaporated fuel from flowing the fuel outlet passage to the fuel inlet passage.

4. The evaporated fuel purge device according to claim 1, further comprising:

a second check valve disposed in the branch passage, wherein the second check valve restricts the evaporated fuel from flowing from the air inlet passage to the fuel inlet passage.

5. The evaporated fuel purge device according to claim 1, wherein an overall dimension of the air inlet passage, the air outlet passage, and the ejector in the extending direction is set smaller than an overall dimension of the fuel inlet passage, the fuel outlet passage, and the main passage in the extending direction.

6. The evaporated fuel purge device according to claim 1, wherein the main passage has a first passage located adjacent to the air outlet passage and extending parallel with the air outlet passage, a second passage extending from the first passage away from the air outlet passage in a direction crossing the first passage, and a third passage extending from the second passage away from the first passage to be parallel with the air inlet passage, and the branch passage is branched from the third passage at a downstream of the valve, and extends in a direction crossing the third passage.

7. The evaporated fuel purge device according to claim 6, wherein the main passage has a crank shape constructed by the first passage, the second passage and the third passage, the first passage extends along a longitudinal direction of the fuel inlet passage, the second passage extends perpendicularly to the first passage, and the third passage extends from the second passage toward the fuel outlet passage in the same direction as the first passage.

8. The evaporated fuel purge device according to claim 1, wherein the fuel outlet passage has an axial direction that is the same as an axial direction of the fuel inlet passage, and the fuel outlet passage has an axial center that is offset from an axial center of the fuel inlet passage.

9. The evaporated fuel purge device according to claim 1, further comprising:

a filter arranged in the second passage to collect a foreign object contained in the evaporated fuel.

10. The evaporated fuel purge device according to claim 9, wherein the valve is located downstream of the filter in an area of the main passage shifting from the second passage to the third passage.

11. An evaporated fuel purge device that purges fuel evaporated from a fuel tank to an engine having a turbocharger, the device comprising:

a unitary integral main purge device body, including a main passage through which the evaporated fuel passes;

a fuel inlet passage through which the evaporated fuel flows into the main passage;

a fuel outlet passage through which the evaporated fuel flows out of the main passage;

a branch passage branched from the main passage at a position downstream of the valve in a flowing direction of the evaporated fuel;

an ejector having a drawing portion that is connected with the branch passage;

an air inlet passage through which intake air flows into the ejector from a downstream of the turbocharger in a flowing direction of the intake air; and an air outlet passage through which the intake air flows out of the ejector to an upstream of the turbocharger in the flowing direction of the intake air; and a valve disposed in the main passage to open or close the main passage, wherein the ejector is located between the air inlet passage and the air outlet passage in the flowing direction of the intake air, the intake air passing through the drawing portion, the drawing portion drawing the evaporated fuel from the branch passage using the intake air passing through the drawing portion, and at least three of the fuel inlet passage, the fuel outlet passage, the air inlet passage, and the air outlet passage extend parallel with each other in an extending direction.

12. The evaporated fuel purge device according to claim 11, wherein all of the fuel inlet passage, the fuel outlet passage, the air inlet passage, and the air outlet passage extend parallel with each other in the extending direction.

13. The evaporated fuel purge device according to claim 11, further comprising:

a first check valve disposed in the main passage at a position between the fuel outlet passage and a branch point from which the branch passage is branched from the main passage, wherein the first check valve restricts the evaporated fuel from flowing from the fuel outlet passage to the fuel inlet passage.

14. The evaporated fuel purge device according to claim 11, further comprising:

a second check valve disposed in the branch passage, wherein the second check valve restricts the evaporated fuel from flowing from the air inlet passage to the fuel inlet passage.

15. The evaporated fuel purge device according to claim 11, wherein an overall dimension of the air inlet passage, the air outlet passage, and the ejector in the extending direction is set smaller than an overall dimension of the fuel inlet passage, the fuel outlet passage, and the main passage in the extending direction.

16. The evaporated fuel purge device according to claim 11, wherein the main passage has a first passage located adjacent to the air outlet passage and extending parallel with the air outlet passage, a second passage extending from the first passage away from the air outlet passage in a direction crossing the first passage, and a third passage extending from the second passage away from the first passage to be parallel with the air inlet passage, and the branch passage is branched from the third passage at a downstream of the valve, and extends in a direction crossing the third passage.

17. The evaporated fuel purge device according to claim 16, wherein the main passage has a crank shape constructed by the first passage, the second passage and the third passage, the first passage extends along a longitudinal direction of the fuel inlet passage, the second passage extends perpendicularly to the first passage, and the third passage extends from the second passage toward the fuel outlet passage in the same direction as the first passage.

18. The evaporated fuel purge device according to claim 11, wherein the fuel outlet passage has an axial direction that is the same as an axial direction of the fuel inlet passage, and the fuel outlet passage has an axial center that is offset from an axial center of the fuel inlet passage.

19. The evaporated fuel purge device according to claim 11, further comprising:

a filter arranged in the second passage to collect a foreign object contained in the evaporated fuel.

20. The evaporated fuel purge device according to claim 19, wherein the valve is located downstream of the filter in an area of the main passage shifting from the second passage to the third passage.

* * * * *